US005617963A

United States Patent [19]

Baziuk et al.

[11] Patent Number: 5,617,963

[45] Date of Patent: Apr. 8, 1997

[54] APPARATUS FOR MOUNTING AN APPLIANCE AT AN OPENING

[75] Inventors: Morris Baziuk, Winnipeg; Jan Vetesnik, Lorette, both of Canada

[73] Assignee: Unique Concepts Inc., Winnipeg, Canada

[21] Appl. No.: 490,521

[22] Filed: Jun. 14, 1995

[51] Int. Cl.[6] ..... B66C 23/18

[52] U.S. Cl. ..... 212/179; 212/202; 248/208

[58] Field of Search ..... 212/179, 199, 212/200, 201, 202, 203, 223, 204; 248/208, 231.21, 231.9, 226.11; 182/60

[56] References Cited

U.S. PATENT DOCUMENTS

| | | | |
|---|---|---|---|
| 1,646,133 | 10/1927 | Bechman et al. | 212/179 |
| 1,775,398 | 9/1930 | Kacena | 212/179 |

FOREIGN PATENT DOCUMENTS

| | | | |
|---|---|---|---|
| 604247 | 4/1926 | France | 212/223 |
| 290682 | 11/1931 | Italy | 212/179 |
| 304484 | 3/1955 | Switzerland | 212/223 |
| 131058 | 10/1959 | U.S.S.R. | 212/179 |

*Primary Examiner*—Thomas J. Brahan
*Attorney, Agent, or Firm*—Adrian D. Battison; Murray E. Thrift

[57] ABSTRACT

The present invention provides an apparatus for mounting an appliance at an opening in a wall, particularly for use with openings in the exterior walls of storage tanks and the like. The apparatus allows men and materials to be safely raised and lowered within the opening, can be moved away from the opening without completely removing the apparatus from the tank, and can be used to mount a variety or different appliances for use through the opening. The apparatus comprises grasping clamps for securing the apparatus to the opening of the wall, an appliance mounting member for connecting an appliance to the grasping clamps, and an appliance for maneuvering through the opening and performing a predetermined task within the tank.

18 Claims, 7 Drawing Sheets

APPARATUS FOR MOUNTING AN APPLIANCE AT AN OPENING

FIELD OF THE INVENTION

The present invention provides an apparatus for mounting an appliance at an opening in a wall, particularly for use with openings in the exterior walls of storage tanks and the like.

BACKGROUND

When working through confined openings in walls such as those in storage tanks, or other large containers or rooms it is difficult and often dangerous for men to enter and leave through the opening. This is particularly true if the floor of the container or room is sloped or otherwise uneven or is located a distance below the opening. Under these circumstances it is important to be able to secure the men as they enter and leave the opening and also as they are working within the container or room. When moving equipment or materials through an opening of this type the difficulties are similar to those of handling the men.

In Olson et al, U.S. Pat. No. 5,147,013 Sep. 15, 1992 an apparatus is shown which mounts on a projection at the opening in a side wall of a storage tank. The apparatus has a plurality of arms which are arranged to be mounted on the interior of the tank at the opening for raising and lowering men and materials within the tank. The arms however block a portion of the opening from the inside and cannot be moved away from the opening without completely removing the apparatus from the tank. Furthermore the apparatus is configured to mount a hoist and a fall arresting device only and is not designed to mount different kinds of appliances at the opening.

An apparatus for mounting an appliance at an opening in a wall is needed which allows men and materials to be safely raised and lowered within the opening, can be moved away from the opening without completely removing the apparatus from the tank, and which can be used to mount a variety or different appliances for use through the opening.

SUMMARY

According to the present invention there is provided an apparatus for mounting an appliance at an opening in a wall, the opening having a projection arranged around a portion of a periphery thereof and a flange extending from the projection, said apparatus comprising: an appliance mounting member; and grasping means fixed to said appliance mounting member for securing to the projection including: a main support member; a first clamp positioning arm pivotally connected to one end of the main support member; a second clamp positioning arm pivotally connected to the main support member at an end opposite the first clamp positioning arm; a first clamping means fixed to the first clamp positioning arm for engaging the flange; a second clamping means fixed to the second clamp positioning arm for engaging the flange; and securing means for engaging a side of the projection; wherein the first and second clamp positioning arms each include an angular adjustment means for adjusting the position of the arms inwards towards and outwards away from a centre of the opening.

Preferably the apparatus includes an appliance comprising: attachment means having removable and reengageable fixing means for fixing to the appliance mounting member; connection means for connecting to the attachment means in a plurality of orientations; a first arm member including a connection member at a first end for engaging the connection means, and a first pivot connection means for pivoting relative to the connection member; a second arm member being pivotally connected at a first end to a second end of the first arm and having a pulley at a second end, said second arm being articulated and arranged such that the second end may be moved into the opening in the wall; and a winch fixed to the second arm member for raising and lowering objects within said opening.

According to a second aspect of the present invention there is provided an apparatus for mounting at an opening in a wall comprising: a mounting means for securing the apparatus to the wall; attachment means having removable and reengageable fixing means for fixing to the mounting means; connection means for connecting to the attachment means in a plurality of orientations; a first arm member including a connection member at a first end for engaging the connection means, and a first pivot connection means for pivoting relative to the connection member; a second arm member being pivotally connected at a first end to a second end of the first arm and having a pulley at a second end, said second arm being articulated and arranged such that the second end may be moved into the opening in the wall; and a winch fixed to the second arm member for raising and lowering objects within said opening.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
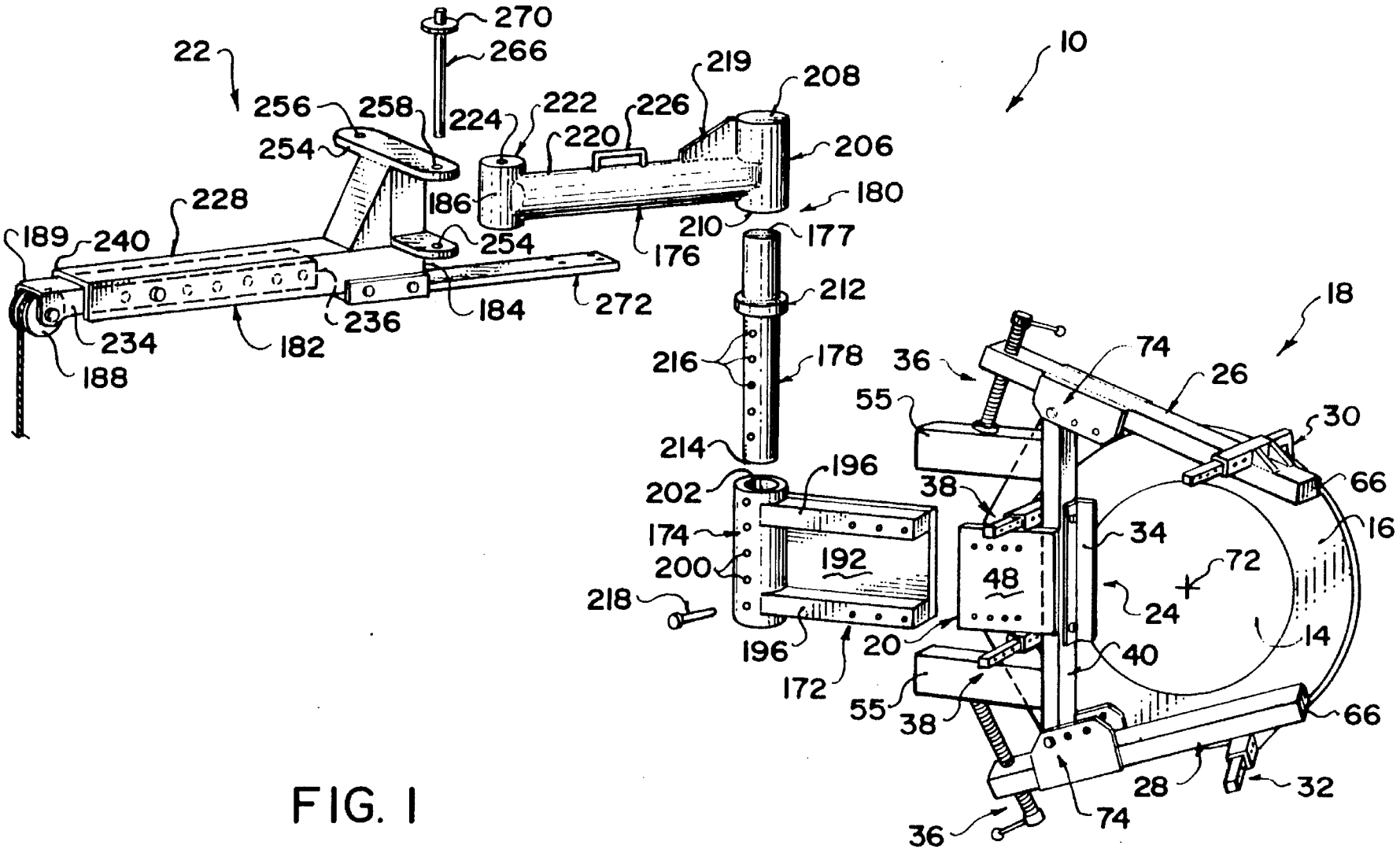
FIG. 1 is an exploded side view of the apparatus and the appliance mounted on the flange.
Figure 2:
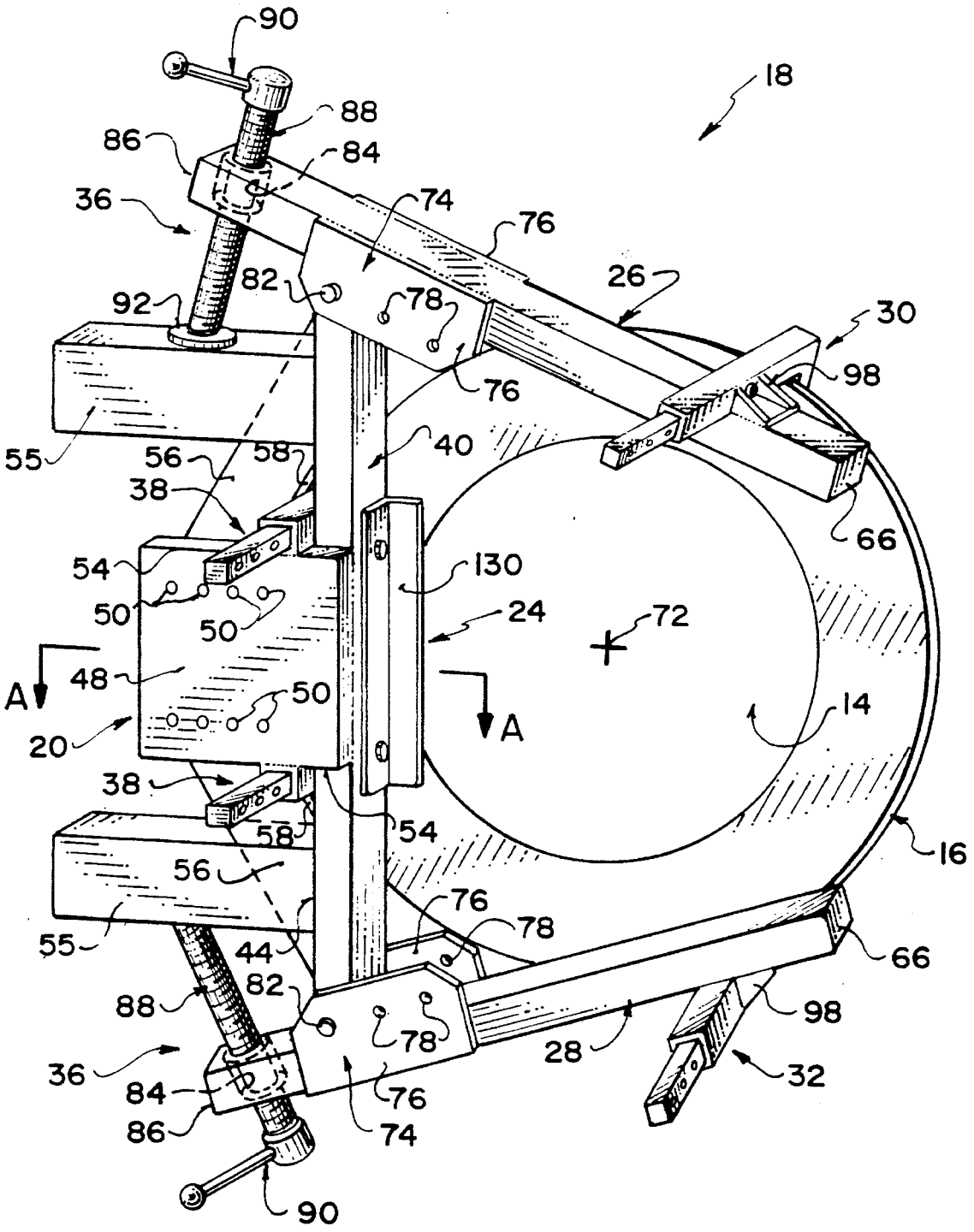
FIG. 2 is an isometric side view of the grasping means mounted on the flange.
Figure 3:
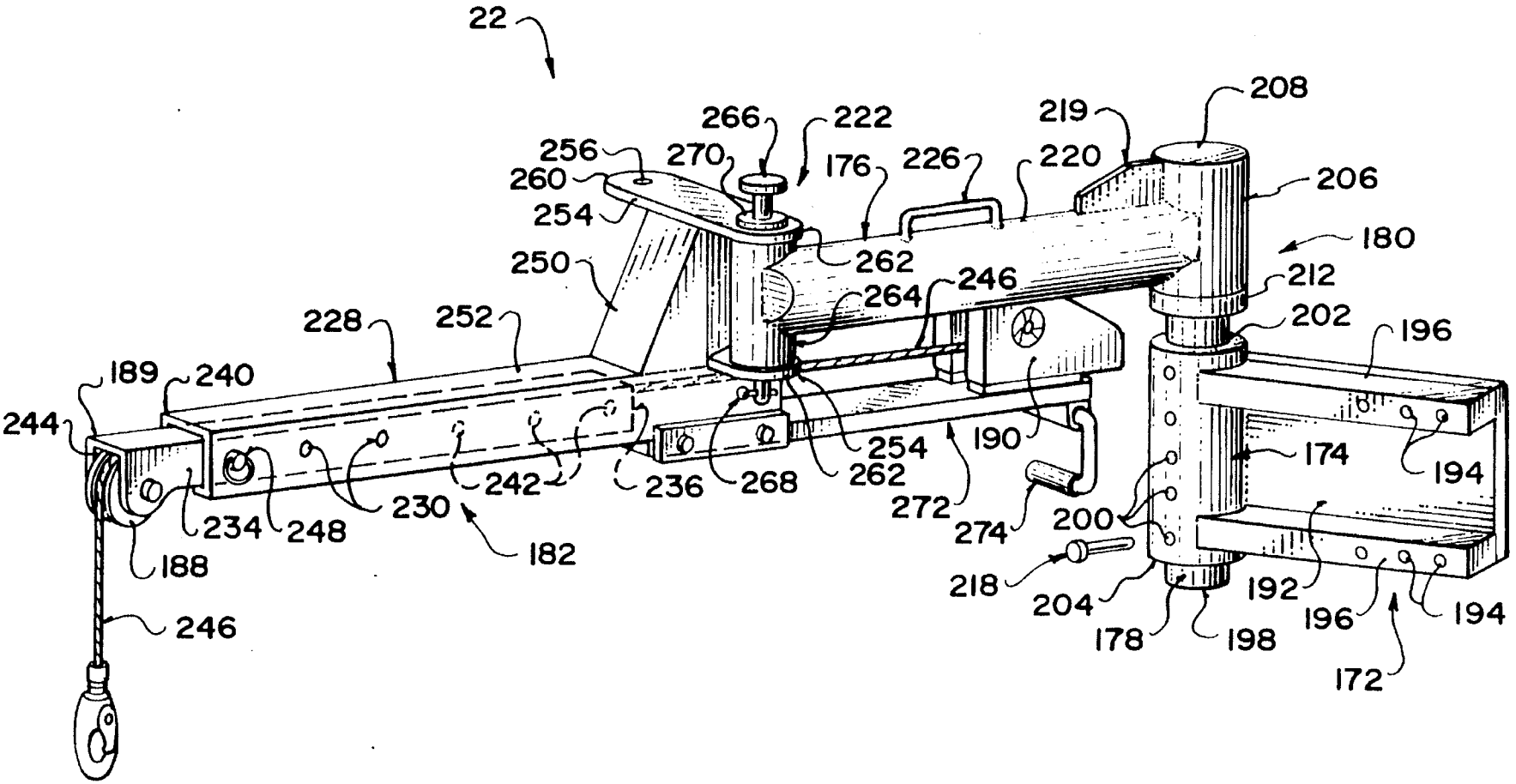
FIG. 3 is an isometric side view of the appliance.

Referring to FIGS. 1, 2 and 3 a preferred embodiment of the apparatus for mounting an appliance at an opening in a wall is shown generally at 10. The apparatus is for use with openings that include a projection 12 arranged around at least a portion of the periphery of the opening 14 and which have a flange 16 extending laterally from at least a portion of the projection 12. The apparatus 10 comprises grasping means 18 for securing the apparatus to the opening 14 of the wall, an appliance mounting member 20 for connecting an appliance 22 to the grasping means 18, and an appliance 22 for maneuvering to the opening 14 and performing a predetermined task through the opening 14.

Figure 4:
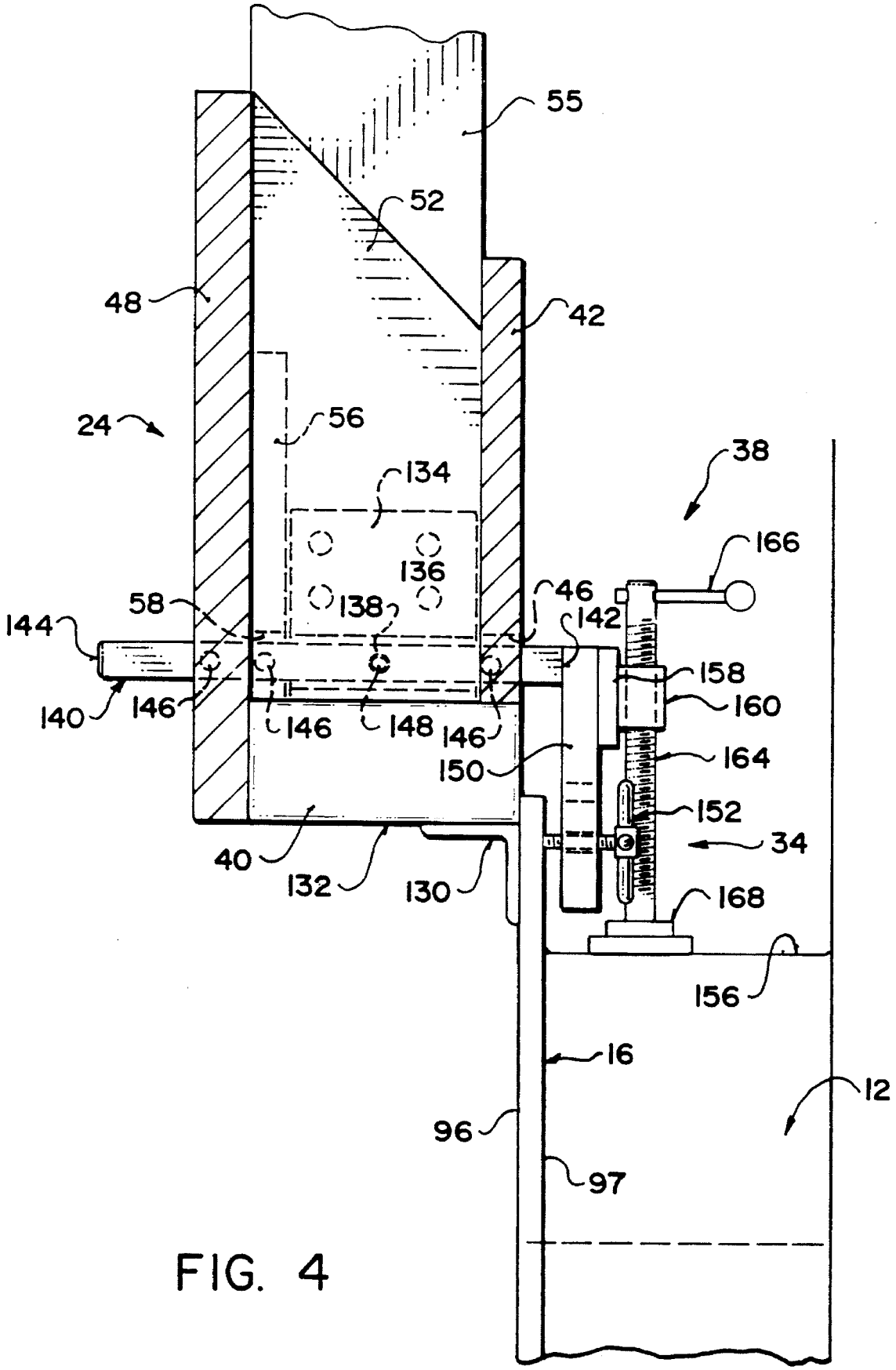
FIG. 4 is top view through A—A of FIG. 2.

Referring to FIGS. 2 and 4 the grasping means 18 comprise a main support member 24, a first clamp positioning arm 26, a second clamp positioning arm 28, a first clamping means 30, a second clamping means 32, securing means 34, angular adjustment means 36, and additional clamping means 38.

The main support member 24 comprises an elongate member 40 for supporting the other components of the grasping means 18 and the appliance mounting member 20.

The main support member 24 has a reinforcing plate 42 lying between its ends to add strength to the elongate member 40 and to the appliance mounting member 20. The reinforcing plate 42 is fixed to the rear side 44 of elongate member 40 and extends rewards therefrom. A pair of holes 46 are located in the reinforcing plate 42. The holes 46 are arranged in a row adjacent the elongate member 40 and are spaced apart from one another along the row. Each one of the holes 46 is arranged to accept a respective one of a pair of additional clamping means 38 therethrough.

The appliance mounting member 20 includes a bolt plate 48 arranged parallel to the back plate 42 and is fixed to the elongate member 40 on an outer side face of the elongate member 40 and extends rearwards therefrom. The bolt plate 48 has a plurality of holes 50 therethrough for receiving bolts which hold the attachment means 172 of the the appliance fixed to the appliance mounting member 20. A pair of side members 52 extend one from each respective side edge 54 of the bolt plate 48 the reinforcing plate 42. The side members 52 add strength to the bolt plate 48 and the reinforcing plate 42.

A pair of cantilevered beams 55 are fixed to the elongate member 40. The cantilevered beams 55 are each arranged to cooperate with a respective one of the angular adjustment means 36 acting as an abutment surface for the angular adjustment means 36. The cantilevered beams 55 are each fixed to the elongate member 40 at a location spaced inwards from a respective end of the elongate member 40 and extend rearwards therefrom.

A pair of reinforcing inserts 56 extend one from each of the cantilevered beams 55 to a respective one of the pair of side members 52. Each reinforcing insert 56 has an opening 58 through it adjacent the elongate member 40. The opening 58 is aligned with a respective one of the pair of holes 46 in the reinforcing plate 42 for accepting one of the pair of additional clamping means 38 therethrough.

First and second clamp positioning arms 26 and 28 are pivotally connected to the elongate member 40, one arm at each end of the elongate member 40. Each arm 26 and 28 is pivotally connected between its ends and extends forwardly from the elongate member 40 to a forward end 66. First and second clamping means 30 and 32 are fixed near respective forward ends 66 of the clamp positioning arms 26 and 28 for engaging the flange 16 on the projection 12 of the opening 14 thereby holding the grasping means 18 in place at the opening 14. The first and second clamp positioning arms 26 and 28 also each include an angular adjustment means 36 for adjusting the position of the arms 26 and 28 inwards towards and outwards away from a center 72 of the opening 14. This allows the arms 26 and 28 to be adjusted to fit various sized openings.

Pivot connection means 74 connect each arm to the elongate member 40. Each pivot connection 74 comprises a pair of spaced apart flanges 76 mounted on a surface of the clamp positioning arm adjacent the elongate member 40. The flanges 76 are arranged parallel to one another with each flange 76 having a plurality of holes 78 spaced along its length. The holes 78 are arranged such that the holes in one flange align with the holes in the flange opposite for selectable cooperation with a hole 80 at the respective end of the elongate member 40. A pin 82 is provided for selectably engaging through the cooperating holes 78 and 80 and thereby connecting each clamp positioning arm 26 and 28 to the elongate member 40.

The angular adjustment means 36 selectably adjust the forward end 66 of each of the clamp positioning arms 26 and 28 from a maximum spaced apart position lying outside the periphery of the opening 14, towards the opening 14 to a minimum spaced apart position. The angular adjustment means 36 comprise a threaded hole 84 extending through each clamp positioning arm 26 and 28 spaced from a rearward end 86 thereof. Each threaded hole 84 is positioned between the pivot connection means 74 and the rearward end 86 of each clamp positioning arm 26 and 28. A threaded elongate member 88 extends through each threaded hole 84. The elongate threaded member 88 is circular in cross section, has a hand crank 90 at a first end and a flat plate 92 at a second end. The flat plate 92 is arranged to cooperate with a respective one of the cantilever beams 55.

When the hand crank 90 of each angular adjustment means 36 is turned in a first direction it causes movement of the respective flat plate 92 away from the respective clamp positioning arm 26 and 28 forcing the rearward end 86 of the clamp positioning arm outwards thereby adjusting the forward end 66 of each arm inwards towards a periphery of the opening 14 and towards the arm opposite.

Turning the hand crank 90 in a second direction opposite to the first causes movement of the flat plate 92 towards a respective clamp positioning arm 26 and 28 allowing the rearward end 86 of the clamp positioning arm to move inwards thereby adjusting the forward end 66 of each arm outwards away from the periphery of the opening 14 and away from the arm opposite.

Figure 5:
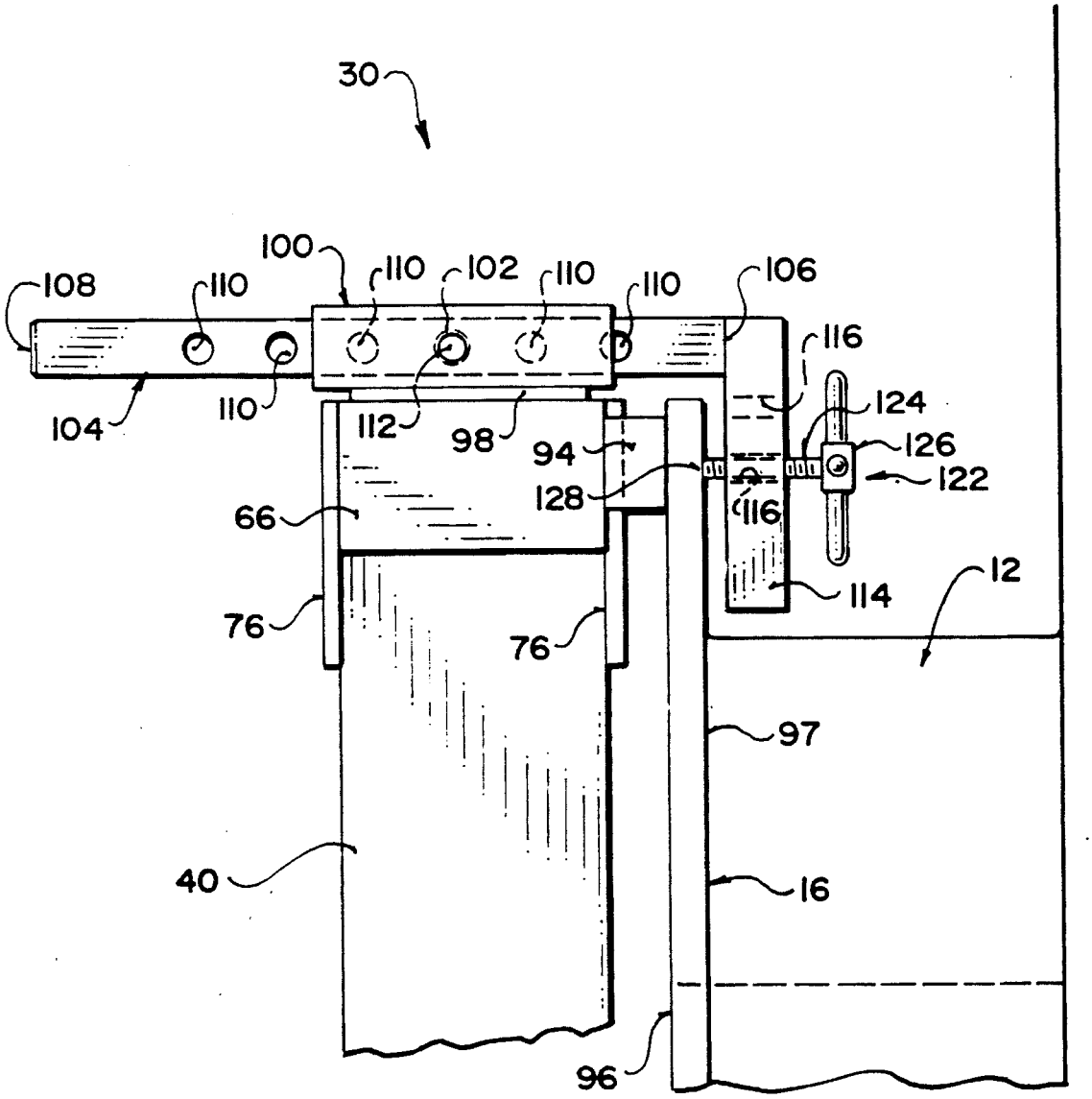
FIG. 5 is a front view of the first clamping means.

Referring to FIGS. 2 and 5 the first and second clamping means 30 and 32 are located near the forward end 66 of each of the clamp positioning arms 26 and 28. Each of the clamping means 30 and 32 is adjustable to allow the grasping means 18 to be secured to a variety of different openings having different projection and flange sizes. Each one of the clamping means 30 and 32 has a fixed clamping member 94 of rectangular cross section fixed on a side of each respective clamp positioning arm 26 and 28 near the forward end 66 thereof for engaging an outside face 96 of the flange 16 on the projection 12. The fixed clamping member 94 provides a reinforcing plate for the movable clamping member 122 to hold the flange 16 in contact therewith, thereby securing the clamp positioning arm 26 and 28 to the flange 16.

The clamp mounting member 98 is fixed near the forward end 66 of each respective clamp positioning arm 26 and 28 and a hollow tubular sleeve member 100 is fixed to each clamp mounting member 98. The hollow tubular member 100 is arranged to extend laterally with respect to the clamp positioning arm 26 and 28 and includes a hole 102 passing through a pair of opposing sides thereof.

An elongate stem member 104 is slidably arranged within the hollow sleeve member 100 and has a first end 106 and a second end 108. The first end 106 extends inwards towards the opening 14 and past the flange 16. The second end 108 extends away from the opening 14. A plurality of holes 110 are spaced longitudinally along the length of the stem member 104 arranged to be selectably aligned with the hole 102 in the hollow tubular member 100. A pin 112 is provided for removably engaging through the aligned holes thereby fixing the stem member 104 in the hollow sleeve member 100 in a desired position.

An extension member 114 is fixed to the first end 106 of the elongate stem member 104 and extends laterally therefrom to a position adjacent an inner face 97 of the flange 16 of the projection 12. The extension member 114 has a plurality of threaded holes 116 arranged such that each hole 116 has a longitudinal axis which intersects a portion of the inner face 97 of the flange 16.

A movable clamping member 122 is located along each one of the extension members 114. The movable clamping member 122 comprises an elongate threaded member 124 with a hand crank 126 mounted at one end, and a contact surface 128 at an end opposite. The movable clamping member 122 is arranged to extend through a selected one of the plurality of the threaded holes 116 in the extension member. When the hand crank 126 is rotated the threads will cause the contact surface 128 of the movable clamping member 122 to move between the extension member 114 and the fixed clamping member 94. This allows the contact surface 128 to be positioned to engage the inner face 97 of the flange 16 of the projection 12 at a point opposite and aligned with the fixed clamping member 94 thereby clamping a portion of the flange 16 therebetween.

Referring to FIG. 4 to further secure the grasping means 18 to the opening 14, the grasping means 18 includes a pair of additional clamping means 38 and a securing means 34 fixed adjacent the main support member 24 for engaging the flange 16 on the projection 12.

The pair of additional clamping means 38 are of substantially the same design as the first and second clamping means 30 and 32 and have the same components with the following differences. The fixed clamping member is angled member 130 arranged on an outer face 132 of a front side of the elongate member 40 and engages a portion of the outer face 96 of the flange 16 of the projection 12. The fixed clamping member 130 provides a surface for the movable portion of the clamp member to hold the flange against.

Each one of the pair of additional clamping means 38 comprises a clamp mounting member 134 which is fixed to a respective one of the side members 52 of the main support member 24. The hollow tubular sleeve member 136 is fixed to the clamp mounting member 134 and is arranged to align with a respective one of the pair of holes 46 in the reinforcing plate 42 and aligns with the opening 58 in a respective one of the reinforcing inserts 56. The hollow tubular member 136 includes a hole 138 passing through a pair of opposing sides thereof.

The elongate stem member 140 is slidably arranged within the hollow sleeve member 136 and has a first end 142 and a second end 144. The first end 142 extends through a respective hole 46 in the reinforcing plate 42 and a second end 144 extends through a respective opening 58 in the reinforcing insert 56. The plurality of holes 146 are spaced longitudinally along the length of the stem member 140 arranged for being selectably aligned with the hole 138 in the hollow tubular member 136. A pin 148 is provided for removably engaging through the aligned holes 138 and 146 fixing the stem member 140 in the hollow sleeve member 136 in a desired position.

The extension member 150 and the movable clamping member 152 are the same as for first and second clamping means 30 and 32. The extension member 150 extends to a position adjacent an inner face 97 of the flange 16 of the projection 12 so that the movable clamping member 152 can engage the inner face 97 of the flange 16 of the projection 12 at a point opposite and aligned with the fixed clamping member 130 thereby clamping a portion of the flange 16 therebetween.

The securing means 34 provide an additional means for securing the grasping means 18 to the opening 12 by engaging the side 156 of the projection 12 instead of a portion of the flange 16 of the projection 12. The securing means 34 include a plate 158 arranged parallel to the elongate support member 40. The plate 158 is fixed to both of the extension members 114 of the additional clamping means 38 and moves with the extension members 114. A hollow internally threaded member 160 is fixed perpendicular to the plate 158 and is arranged such that a longitudinal axis thereof intersects an outer portion of a side 156 of the projection 12. A threaded elongate member 164 extends through the hollow internally threaded member 160. The threaded elongate member 164 is circular in cross section and has a hand crank 166 at a first end and a flat plate 168 at a second end and is arranged such that actuating the hand crank 166 will cause the flat plate 168 to move between the hollow internally threaded member 160 and the outer portion 156 of the projection 12 thereby engaging the outer surface of the projection 12.

The grasping means 18 are designed to provide a secure mount for the attachment of a variety of different appliances which can be used at the opening in a wall. One such appliance is an articulated arm which can be pivoted into position through the opening in the wall to allow the raising and lowering of a man and/or of materials through the opening. The arm may be pivoted away from the opening when not in use.

Referring to FIGS. 1 and 3 the appliance 22 includes attachment means 172 for fixing to the appliance mounting member 20 thereby securing the appliance 22 adjacent the opening 14 in the wall. A connection means 174 is fixed to the attachment means 172 for holding the appliance 22 in a plurality of orientations. A first arm member 176 has a connection member 178 at a first end which engages the connection means 174, and a first pivot connection means 180 for pivoting relative to the connection member 178. A second arm member 182 is pivotally connected at a first end 184 to a second end 186 of the first arm 176. The second arm 182 is sized and arranged to be positioned through the opening 14 in the wall and has a pulley 188 at its second end 189. A winch 190 is fixed to the second arm 182 member for raising and lowering objects within the opening 14.

The attachment means 172 include a substantially flat plate 192 sized and arranged for face to face cooperation with the appliance mounting member 20. The attachment means 172 has a plurality of holes 194 in the flat plate 192 arranged to align with the holes 50 in the appliance mounting member 20 for receiving removable and reengageable fixing means therethrough. In this embodiment bolts provide the removable and reengageable fixing means. Appliance support members 196 comprising a pair of spaced apart elongate members are fixed to the flat plate 192 adjacent respective sides of the flat plate 192 and extend rearwards therefrom. The appliance support members 196 are fixed to the connection means 174 and support the appliance 172 on the attachment means 172.

The connection means 174 is fixed to the appliance support members 196 and is arranged for accepting an end 198 of the connection member 178 of the first arm 176. The connection means 174 is a hollow tube having a plurality of holes 200 arranged longitudinally therealong, and is open at each end 202 and 204 and arranged parallel to the main support member 24. The connection means 174 is arranged to selectively accept the bottom end of the connection member 178 through one of its open ends 202 and 204. The connection member 178 can therefore be placed in one of two selectable orientations, a first and second, arranged 180 degrees to one another thereby allowing the appliance to be positioned for use on one or the other of opposing sides of the opening.

The first pivot connection means 180 comprise a hollow cylindrical member 206 and has a closed top end 208 and an open bottom end 210. The hollow member 206 is sized and arranged to accept the top end 177 of the connection member 178 through its open bottom end 210. A bearing means 212 connects the hollow member 206 to the top of the connection member 177 and is arranged to allow smooth controlled rotation of the hollow member 206 relative to the connection member 178 about an axis longitudinal to the connection member 178.

The first arm member 176 is an elongate member fixed at a first end to a first pivot connection means 180 and extends therefrom. The first pivot connection means 180 allows pivoting of the first arm 176 relative to the connection member 178 and is connected to the top end 177 of the connection member 178. The connection member 178 is an elongate member and includes the top end 177, a bottom end 214, a plurality of holes 216 arranged for cooperation with a selected one of the holes 200 on the connection means 174. A pin 218 engages through the cooperating holes 200 and 216 fixing the connection member 178 to the connection means 174. A reinforcing plate 219 is fixed to an upper surface 220 of the first arm member 176. The reinforcing plate 219 adds strength to the connection. A second pivot connection means 222 is fixed to a second end 186 of the first arm member 176. The second pivot connection member 222 is a cylindrical member arranged in a vertical plane and has hole 224 extending through its length. A handle 226 is fixed to the upper surface 220 of the first arm member 176 between the first and second ends of said arm. The handle 226 aids the operator in maneuvering the appliance 170 into and out of position at the opening 14.

The second arm member 182 includes a hollow first elongate member 228 having a plurality of paired holes 230 spaced along opposing sides thereof and is connected to the second pivot connection means 222 of the first arm 176 at a first end 184.

A second elongate member 234 has a first end 236 slidably arranged within the first elongate member 228 and projects outwards from the second end 240 of the first elongate member 228 to a second end 189. A plurality of holes 242 are spaced along opposing sides of the second elongate member 234 and are arranged to cooperate with the holes 230 on the first elongate member 228. The second elongate member 234 has a passage 244 arranged longitudinally along its length for guiding a flexible elongate connection means 246 through the arm. A pulley 188 is mounted at the second end 189 of the second elongate member 234 to guide the flexible elongate connection means 246 into the opening 14.

A removable and reengageable pin 248 is provided for engaging cooperating pairs of holes 230 and 242 in the first and second elongate members 228 and 234 thereby fixing the second elongate member 234 in one of a number of longitudinally adjustable positions.

The second pivot connection means 222 includes a support member 250 fixed to the first end 184 of the second arm member 182. The support member 250 extends upwards from the top surface 252 of the second arm member 182. A pair of plates 254 are fixed to the support member 250 and are spaced apart vertically from one another. The plates 254 are arranged to extend outwards from the second arm member 182 on both sides thereof. Each plate 254 has a hole 256 and 258 located at an end 260 and 262 thereof. The holes 256 and 258 are arranged such that the holes 256 and 258 at said respective ends of the plates are aligned vertically with one another. The cylindrical member 264 on the first arm member 176 is arranged between the plates 254 such that the holes 256 and 258 in a selected end of the plates 254 are aligned with the holes 224 and 258 in the cylindrical member 264 and a removable and reengageable pin 266 engages through the aligned holes in the spaced apart plates 254. The pin 266 has retainer means 268 at one end and a flange 270 at an end opposite to hold it in place in the holes 256 and 258.

The winch 190 allows the flexible elongate connection means 246 to be extended and retracted through the opening 14 in the wall. The winch 190 includes a winch support 272 having a substantially flat plate member fixed to the first end 236 of the second arm 182 and actuation means 274. The support 272 extends rearwards from the second arm member 182 and the winch 190 is fixed to the winch support 272. The flexible elongate connection means 246 is usually a cable or a chain. The actuation means 274 are arranged such that actuation of the actuation means 274 will cause the flexible elongate connection means 246 to be extended and retracted.

Figure 6:
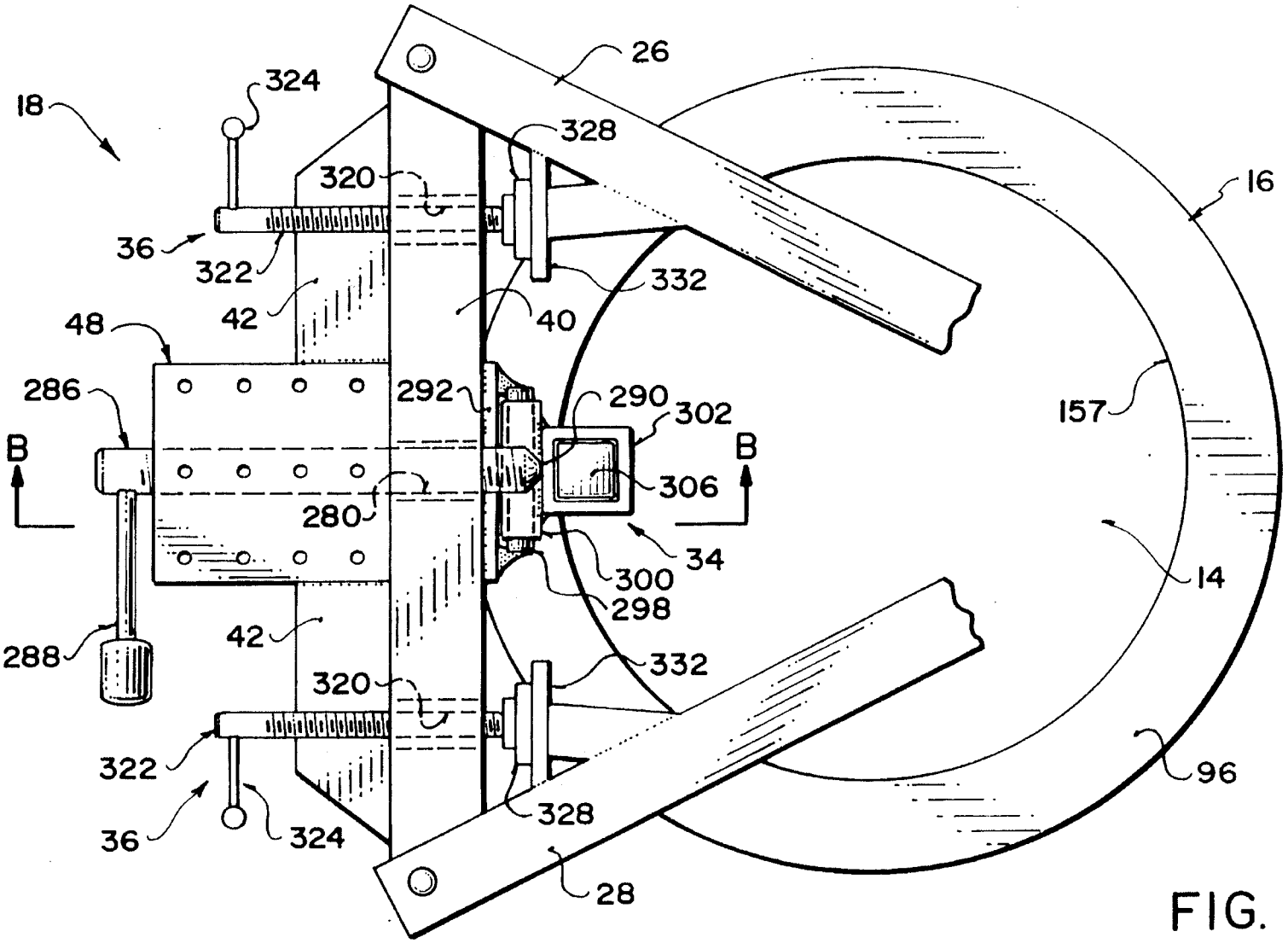
FIG. 6 is a side view of the alternative securing means.
Figure 7:
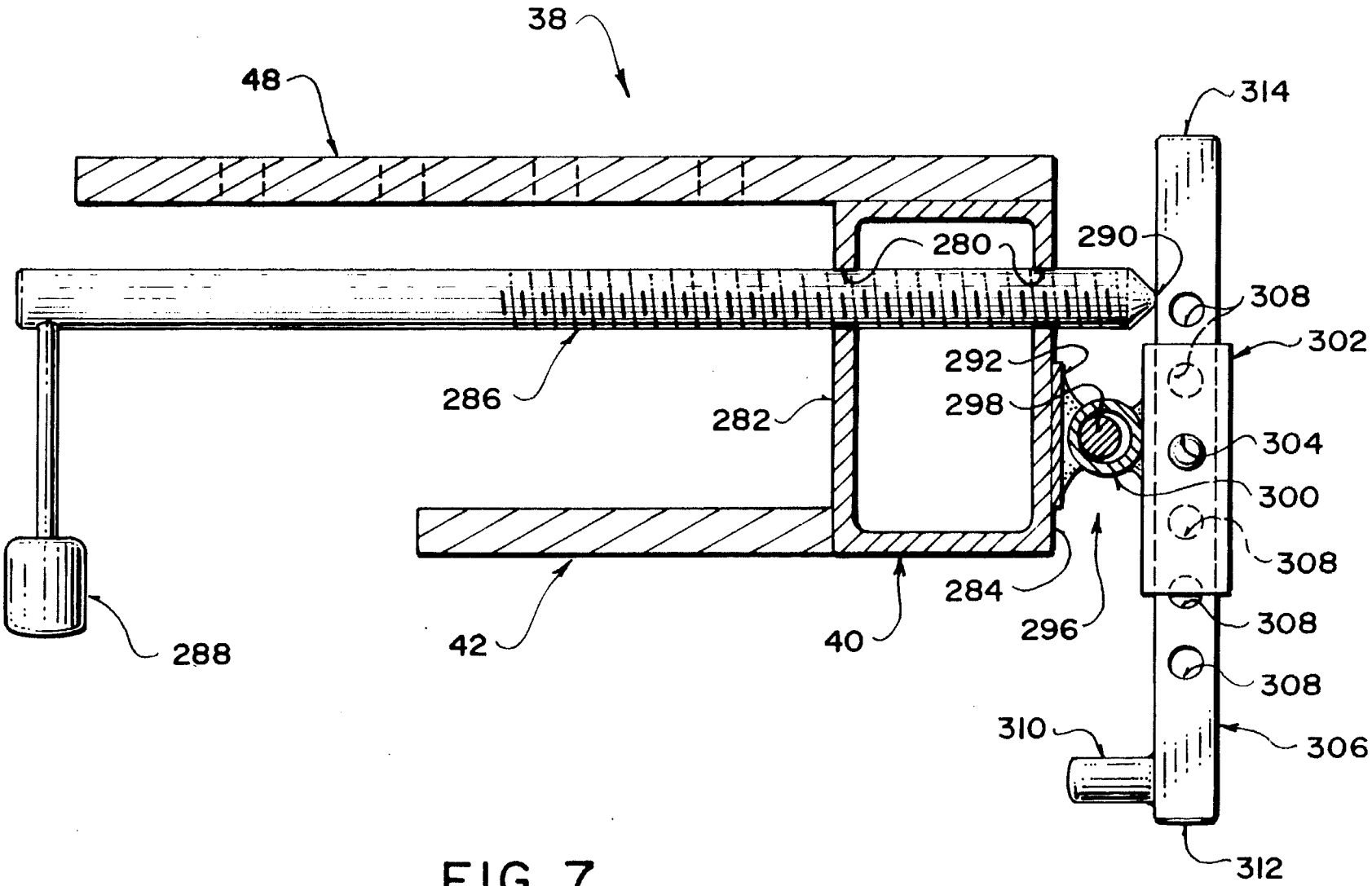
FIG. 7 is a view through B—B of FIG. 6.

Referring to FIGS. 6 and 7 one alternative arrangement of the grasping means 18 is shown. The main support member 24 is arranged such that the clamp positioning arms 26 and 28 are mounted to be selectably adjustable from a minimum spaced apart position lying inside the periphery of the opening 14, towards the periphery of the opening 14 to a maximum spaced apart position. This requires the main support member 24, securing means 34, and the additional clamping means 38 be configured differently.

In the alternative the main support member 24 includes an elongate member 40 and a reinforcing plate 42. The reinforcing plate 42 is fixed to the elongate member 40' between the ends thereof and extends rearwards therefrom.

The securing means 34' are significantly different and extend over the outer face 96 of the flange 16 to engage an internal surface 157 of the projection 12. The securing means 34' include a threaded hole 280 extending through the elongate member 40' from a rear face 282 to a front face 284 thereof. A threaded elongate member 286 extends through the threaded hole 280. The threaded member 286 is circular in cross section and has with a hand crank 288 at a first end and a contact face 290 at a second end. A plate 292 is arranged longitudinally along a front surface 284 of the elongate member 40' and is fixed thereto. A pivot connector 296 is fixed to the plate 292. The pivot connector 296 has a pin member 298 spaced from the plate 292 and fixed to the plate 292 at each of its ends. A cylindrical sleeve 300 surrounds a portion of the pin 298 between the fixed ends such that the sleeve 300 may rotate about said pin 298. A hollow sleeve member 302 is fixed to the pivot connector 296 and has a hole 304 passing through opposing sides thereof. A lever member 306 is slidably arranged within the sleeve member 300 and has holes 308 spaced therealong for alignment with the hole 304 in the sleeve member 300. A hook 310 is located at the first end 312 of the lever member 306 and engages the inner surface 157 of the projection 12. A second end 314 of the lever member 306 is arranged to cooperate with the contact face 290 of the threaded elongate member 286.

Turning the hand crank 288 in a first direction causes movement the first end 312 of the lever member 306 outwards causing the second end 314 of the lever member 306 to move inwards towards the inner surface 157 of the projection 12 thereby grasping said projection 12;

Turning the hand crank 288 in a second direction causes movement of the first end 312 of the lever member 306 inwards causing the second end 314 of the lever member 306 to move outwards away from the inner surface 157 of the projection 12 thereby grasping said projection 12.

The angular adjustment means 36' include a threaded hole 320 in the elongate member 40' spaced in from each end. A threaded elongate member 322 extends through each of the threaded holes 320. Each threaded elongate member 322 is circular in cross section and has a hand crank 324 at a first end and a flat plate 328 at the second end. An abutment plate 332 is fixed at an angle to each of the clamp positioning arms 26' and 28' at a position forward of the pivot connection. The abutment plate 332 is arranged for cooperation with the flat plate 328.

Turning each hand crank 324 in a first direction causes movement of a respective flat plate 328 away from a respective abutment plate 332 thereby adjusting the forward end 66' of each respective clamp positioning arm 26' and 28' inwards away from the periphery of the opening 14 and towards arm opposite.

Turning each hand crank 324 in a second direction causes movement of the a respective flat plate 328 towards a respective abutment plate 332 thereby adjusting the forward end 66, of each respective clamp positioning arm 26, and 28, outwards towards the periphery of the opening and away from arm opposite.

While one embodiment of the present invention has been described in the foregoing, it is to be understood that other embodiments are possible within the scope of the invention. The invention is to be considered limited solely by the scope of the appended claims.

I claim:

1. A combination of a wall having an opening therein and an apparatus for mounting an appliance at said opening of said wall comprising:

the wall comprising:

a projection arranged around at least a portion of a periphery of the opening including a side wall extending outwards from a plane of the wall, said side wall having a first surface adjacent the opening and a second surface opposite the first surface, and a flange extending laterally from the side wall of the projection, said flange having an inner face adjacent the wall and an outer face opposite the inner face;

the apparatus comprising:

an appliance mounting member;

and grasping means fixed to said appliance mounting member for securing the apparatus to the projection including:

a main support member;

a first clamp positioning arm pivotally connected by pivot connection means adjacent a first end to an end of the main support member and extending forwards therefrom to a second end;

a second clamp positioning arm pivotally connected by pivot connection means adjacent a first end to the main support at an end of the main support member opposite the first clamp positioning arm and extending forwards therefrom to a second end;

a first clamping means fixed adjacent the second end of the first clamp positioning arm and engaging the inner and outer faces of the flange;

a second clamping means fixed adjacent the second end of second clamp positioning arm and engaging the inner and outer faces of the flange;

securing means mounted on the main support member and engaging a portion of the side wall of the projection;

a first angular adjustment means for independently adjusting a position of the second end of the first clamp positioning arm both towards and away from the periphery of the opening;

and a second angular adjustment means for independently adjusting a position of the second end of the second clamp positioning arm both towards and away from the periphery of the opening.

2. The combination in accordance with claim 1 wherein the appliance mounting member comprises: a bolt plate fixed on an outer side face of the main support member extending rearwards therefrom, and a plurality of holes through said bolt plate for receiving removable and reengageable fixing means therethrough.

3. The combination in accordance with claim 1 wherein the first and second clamping means each comprise:

an elongate stem member mounted on a respective one of the clamp positioning arms near the second end thereof and having an end extending towards the plane of the wall;

an extension member fixed adjacent the end of the elongate stem member and extending therefrom to a position adjacent the inner face of the flange;

a movable clamping member mounted on the extension member having an actuating means mounted at one end and a contact surface at an end opposite;

a fixed clamping member fixed on a side of a respective clamp positioning arm near the forward end thereof and opposite the movable clamping member, said fixed clamping member engaging the outer face of the flange;

and wherein rotating the actuating means will cause the contact surface of the movable clamping member to move between the extension member and the fixed clamping member engaging the inner face of the flange at a point opposite and aligned with the fixed clamping member thereby clamping a portion of the flange therebetween.

4. The combination in accordance with claim 1 wherein the grasping means includes a plurality of additional clamping means fixed adjacent the main support member for engaging the flange on the projection.

5. The combination in accordance with claim 4 wherein each one of the plurality of additional clamping means comprises:

a elongate stem member having an end extending laterally inwards towards the plane of the wall;

an extension member fixed adjacent the end of the elongate stem member and extending therefrom to a position adjacent an inner face of the flange;

a movable clamping member mounted on the extension member having an actuating means mounted at one end and a contact surface at an end opposite;

a fixed clamping member arranged on an outer face of a front side of the support member for engaging a portion of the outer face of the flange;

and wherein rotating the actuating means will cause the contact surface of the movable clamping member to move between the extension member and the fixed clamping member engaging the inner face of the flange of the projection at a point opposite and aligned with the fixed clamping member thereby clamping a portion of the flange therebetween.

6. The combination in accordance with claim 1 wherein the securing means comprise:

a plate arranged parallel to the main support member and fixed to the extension members of the plurality of clamping means for movement therewith;

a hollow internally threaded member fixed perpendicular to the plate and being arranged such that a longitudinal axis thereof intersects the second surface of the side wall of the projection;

a threaded elongate member extending through the hollow internally threaded member and having actuating means at a first end and a plate member at the second end and being arranged such that actuating the actuating means will cause the plate member to move between the hollow internally threaded member and the second surface of the side wall of the projection thereby engaging the second surface of the side wall of the projection.

7. The combination in accordance with claim 1 wherein the first and second angular adjustment means selectably adjust a forward end of each of the clamp positioning arms from a maximum spaced apart position lying outside the periphery of the opening, to a spaced apart position adjacent the periphery of the opening.

8. The combination in accordance with claim 7 wherein the first and second angular adjustment means comprise:

a pair of cantilevered beams each one being arranged to cooperate with the angular adjustment means, and being fixed to the elongate member spaced inwards from a respective end thereof and extending rearwards therefrom;

a threaded hole extending through each clamp positioning arm spaced from a rearward end thereof and lying between the pivot connection means and said rearward end;

a threaded elongate member extending through said threaded hole and having actuating means at a first end and a plate member at the second end, said flat member being arranged to cooperate with an upper surface of a respective one of the cantilever beams;

and wherein turning each actuating means in a first direction causes movement of a respective plate member away from a respective clamp positioning arm thereby adjusting the forward end of each arm inwards towards a periphery of the opening and the arm opposite;

and wherein turning each actuating means in a second direction causes movement of a respective plate member towards a respective clamp positioning arm thereby adjusting the forward end of each arm outwards away from the periphery of the opening and the arm opposite.

9. The combination in accordance with claim 1 wherein the main support member comprises:

an elongate member;

a reinforcing plate arranged parallel to the appliance mounting member and fixed to the elongate member between the ends thereof and extending rearwards therefrom;

a plurality of holes in the reinforcing plate spaced apart from one another and lying adjacent to the elongate member for accepting the plurality of additional clamping means therethrough;

and a pair of side members each one extending from a respective side edge of the appliance mounting member to the reinforcing plate.

10. The combination in accordance with claim 1 wherein the main support member comprises:

an elongate member;

a reinforcing plate fixed to the elongate member between the ends thereof and extending rearwards therefrom.

11. The combination in accordance with claim 10 wherein the securing means comprises:

a threaded hole extending through the elongate member from a rear face to a front face;

a threaded elongate member extending through said threaded hole, having with actuating means at a first end and a contact face at a second end;

a plate fixed longitudinally along a front surface of the elongate member and being fixed thereto;

a pivot connector having a pin member being spaced from the plate and fixed to the plate at each of its ends, and a sleeve surrounding a portion of the pin between the fixed ends such that the sleeve may rotate about said pin;

a hollow sleeve member being fixed to the pivot connector and having a hole passing through opposing sides thereof;

a lever member being slidably arranged within the hollow sleeve member having holes spaced therealong for alignment with the hole in the hollow sleeve member, a first end with a hook arranged for engaging an inner side surface of the projection, and a second end arranged to cooperate with the contact face of the threaded elongate member;

and wherein turning the actuating means in a first direction causes movement the first end of the lever member outwards causing the second end of the lever member to move inwards towards the inner side surface of the projection thereby grasping said projection;

and wherein turning the actuating means in a second direction causes movement of the first end of the lever member inwards causing the second end of the lever member to move outwards away from the inner side surface of the projection thereby grasping said projection.

12. The combination in accordance with claim 10 wherein the first and second angular adjustment means selectably adjust the forward end of each of the clamp positioning arms from a minimum spaced apart position lying inside the periphery of the opening, outwards towards the opening to a maximum spaced apart position.

13. The combination in accordance with claim 12 wherein the first and second angular adjustment means comprise:

a threaded hole in the elongate member spaced in from each end;

a threaded elongate member extending through each of the threaded holes having actuating means at a first end and a plate member at a second end;

an abutment plate fixed at an angle to each of the clamp positioning arms at a position forward of the pivot connection and arranged for cooperation with the flat plate;

and wherein turning the actuating means of a respective threaded elongate member in a first direction causes movement of a respeetive plate member away from a respective abutment plate thereby adjusting the forward end of each respective clamp positioning arm away from the periphery of the opening and the arm opposite;

and wherein turning the actuating means of a respective threaded elongate member in a second direction causes movement of the a respective plate member towards a respective abutment plate thereby adjusting the forward end of each respective clamp positioning arm towards the periphery of the opening and the arm opposite.

14. The combination in accordance with claim 1 wherein the apparatus includes an appliance comprising:

attachment means having removable and reengageable fixing means for fixing to the appliance mounting member;

connection means for connecting to the attachment means in a plurality of orientations;

a first arm member including a connection member at a first end for engaging the connection means, and a first pivot connection means for pivoting relative to the connection member;

a second arm member being pivotally connected at a first end to a second end of the first arm and having a pulley at a second end, said second arm being articulated and arranged such that the second end may be moved into the opening in the wall;

and a winch fixed to the second arm member for raising and lowering objects within said opening.

15. The combination in accordance with claim 14 wherein the attachment means comprise:

a substantially flat plate sized and arranged for cooperation with the appliance mounting member;

a plurality of holes in the flat plate arranged for alignment with holes in the appliance mounting member;

appliance support members comprising a pair of spaced apart elongate members each one being fixed to the flat plate adjacent a respective side of the flat plate and extending rearwards therefrom;

and wherein the connection means is fixed to the appliance support members for accepting the first end of the connection member of the first arm.

16. The combination in accordance with claim 15 wherein the connection means comprise:

a hollow tube being open at each end and arranged parallel to the main support member;

and wherein the connection means is arranged to accept the first end of the connection member through one of the open ends of the hollow tube thereof.

17. The combination in accordance with claim 14 wherein the second arm includes:

a hollow first elongate member;

a second elongate member slidably arranged within the first elongate member projecting outwards from the second end thereof, and being arranged such that the second elongate member can be repositioned longitudinally with in the first elongate member between a plurality of selectable positions.

18. The combination in accordance with claim 14 wherein the winch comprises:

a winch support having a substantially flat plate member fixed to the first end of the second arm and extending rearwards therefrom;

and a winch fixed to the winch support having a flexible elongate connection means and actuation means arranged such that actuation of the actuation means will cause the flexible elongate connection means to be extended and retracted.

* * * * *